US006462006B1

(12) United States Patent
Sorg et al.

(10) Patent No.: US 6,462,006 B1
(45) Date of Patent: Oct. 8, 2002

(54) SOLID MACHINE DISHWASHING DETERGENT WITH PHOSPHATE AND CRYSTALLINE LAMELLAR SILICATES

(75) Inventors: Rainer Sorg, Dormagen (DE); Christian Nitsch, Duesseldorf (DE); Juergen Haerer, Duesseldorf (DE); Harald Volk, Mondercange (LU); Thomas Mueller-Kirschbaum, Solingen (DE); Peter Krings, Drefeld (DE); Harald Bauer, Kerpen (DE); Josef Holz, Erftstadt (DE); Guenther Schimmel, Erftstadt (DE); Lothar Westermann, Cologne (DE)

(73) Assignees: Henkel Kommanditgesellschaft auf Aktien, Duesseldorf (DE); Clariant GmbH, Huerth (DE)

( * ) Notice: Subject to any disclaimer, the term of this patent is extended or adjusted under 35 U.S.C. 154(b) by 0 days.

(21) Appl. No.: 09/674,154

(22) PCT Filed: May 28, 1999

(86) PCT No.: PCT/EP99/02679

§ 371 (c)(1),
(2), (4) Date: Dec. 22, 2000

(87) PCT Pub. No.: WO99/57237

PCT Pub. Date: Nov. 11, 1999

(30) Foreign Application Priority Data

Apr. 30, 1998 (DE) ..... 198 19 187

(51) Int. Cl.[7] ..... C11D 3/06; C11D 3/12; C11D 3/37; C11D 17/00; C11D 17/06

(52) U.S. Cl. ..... 510/220; 510/224; 510/229; 510/230; 510/232; 510/233; 510/438; 510/446

(58) Field of Search ..... 510/220, 224, 510/438, 229, 230, 232, 233, 446

(56) References Cited

U.S. PATENT DOCUMENTS

| | | | | |
|---|---|---|---|---|
| 3,923,742 A | | 12/1975 | Haschke et al. | |
| 4,834,902 A | | 5/1989 | Pioch et al. | |
| 4,839,075 A | * | 6/1989 | Puchta et al. | 510/332 |
| 4,839,461 A | | 6/1989 | Boehmke | |
| 4,849,125 A | * | 7/1989 | Seiter et al. | 510/443 |
| 4,898,621 A | | 2/1990 | Pruehs et al. | |
| 5,066,415 A | | 11/1991 | Dany et al. | |
| 5,175,361 A | | 12/1992 | Denzinger et al. | |
| 5,227,446 A | | 7/1993 | Denzinger et al. | |
| 5,540,855 A | * | 7/1996 | Baillely et al. | 510/276 |
| 5,574,120 A | | 11/1996 | Heidel et al. | |
| 5,580,941 A | | 12/1996 | Krause et al. | |
| 5,747,635 A | | 5/1998 | Kroner et al. | |
| 5,760,154 A | | 6/1998 | Krause et al. | |
| 5,783,616 A | | 7/1998 | Krause et al. | |
| 5,830,956 A | | 11/1998 | Stockhausen et al. | |
| 5,888,954 A | | 3/1999 | Haerer et al. | |
| 5,900,399 A | * | 5/1999 | Seiter et al. | 510/446 |
| 6,043,292 A | | 3/2000 | Huygens et al. | |
| 6,075,001 A | | 6/2000 | Wilde | |
| 6,114,297 A | * | 9/2000 | Yamaguchi et al. | 510/351 |

FOREIGN PATENT DOCUMENTS

| | | |
|---|---|---|
| DE | 23 57 036 | 5/1975 |
| DE | 36 26 672 | 2/1988 |
| DE | 40 03 172 | 8/1991 |
| DE | 41 28 672 | 3/1993 |
| DE | 42 21 381 | 2/1994 |
| DE | 43 00 772 | 7/1994 |
| DE | 43 07 114 | 9/1994 |
| DE | 43 25 922 | 2/1995 |
| DE | 43 38 724 | 5/1995 |
| DE | 43 43 993 | 6/1995 |
| DE | 44 15 623 | 11/1995 |
| DE | 44 16 438 | 11/1995 |
| DE | 44 27 287 | 2/1996 |
| DE | 44 39 978 | 5/1996 |
| DE | 44 43 177 | 6/1996 |
| DE | 195 16 957 | 11/1996 |
| DE | 195 29 905 | 2/1997 |
| DE | 195 36 082 | 4/1997 |
| DE | 196 05 688 | 8/1997 |
| DE | 196 13 103 | 10/1997 |
| DE | 196 20 411 | 10/1997 |
| DE | 196 16 693 | 11/1997 |
| DE | 196 16 767 | 11/1997 |
| DE | 196 16 769 | 11/1997 |
| DE | 196 16 770 | 11/1997 |
| DE | 196 20 267 | 11/1997 |
| DE | 197 09 284 | 9/1998 |
| EP | 0 075 820 | 4/1983 |
| EP | 0 272 030 | 6/1988 |
| EP | 0 283 885 | 9/1988 |
| EP | 0 300 305 | 1/1989 |
| EP | 0 392 592 | 10/1990 |
| EP | 0 416 366 | 3/1991 |
| EP | 0 443 651 | 8/1991 |
| EP | 0 446 982 | 9/1991 |
| EP | 0 451 508 | 10/1991 |
| EP | 0 453 003 | 10/1991 |
| EP | 0 458 397 | 11/1991 |
| EP | 0 458 398 | 11/1991 |
| EP | 0 504 091 | 9/1992 |

(List continued on next page.)

OTHER PUBLICATIONS

Alltägliches mit High Tech Dimension, *Hoeschst High Chem Magazin*, No. 14, pp. 33–38 (1993).*

*Seifen–Öle–Fette–Wachse*, vol. 116, No. 20, pp. 805–808 (1990).*

*Primary Examiner*—Lorna M. Douyon
(74) *Attorney, Agent, or Firm*—Stephen D. Harper; Glenn E.J. Murphy

(57) ABSTRACT

A solid-form dishwasher detergent that contains a builder combination of conventional phosphates and crystalline layer silicates. Despite its phosphate content, the detergent provides improved protection to sensitive tableware, more particularly glasses and decorated tableware, and improved cleaning performance.

19 Claims, No Drawings

FOREIGN PATENT DOCUMENTS

| | | | | |
|---|---|---|---|---|
| EP | 0 525 239 | | | 2/1993 |
| EP | 0 544 490 | | | 6/1993 |
| EP | 0 544 519 | | | 6/1993 |
| EP | 0 549 271 | | | 6/1993 |
| EP | 0 549 272 | | | 6/1993 |
| EP | 0 564 476 | | | 10/1993 |
| EP | 0 612 784 | | | 8/1994 |
| EP | 0 644 257 | | | 3/1995 |
| EP | 0653480 | A1 | * | 5/1995 |
| EP | 0 693 550 | | | 1/1996 |
| EP | 0737738 | A2 | * | 10/1996 |
| EP | 0 849 355 | | | 6/1998 |
| WO | WO 91/02792 | | | 3/1991 |
| WO | WO 91/14762 | A1 | * | 10/1991 |
| WO | WO 92/14753 | | | 9/1992 |
| WO | WO 92/21760 | | | 12/1992 |
| WO | WO 94/01486 | | | 1/1994 |
| WO | WO 94/02597 | | | 2/1994 |
| WO | WO 94/02618 | | | 2/1994 |
| WO | WO 94/05762 | | | 3/1994 |
| WO | WO 94/15978 | | | 7/1994 |
| WO | WO 94/16047 | | | 7/1994 |
| WO | WO 94/18314 | | * | 8/1994 |
| WO | WO 94/23005 | | * | 10/1994 |
| WO | WO 94/23053 | | * | 10/1994 |
| WO | WO 94/27970 | | * | 12/1994 |
| WO | WO 94/28102 | | * | 12/1994 |
| WO | WO 94/28103 | | * | 12/1994 |
| WO | WO 95/00626 | | * | 1/1995 |
| WO | WO 95/07350 | | * | 3/1995 |
| WO | WO 95/14075 | | * | 5/1995 |
| WO | WO 95/14759 | | * | 6/1995 |
| WO | WO 95/17498 | | * | 6/1995 |
| WO | WO 95/23221 | | * | 8/1995 |
| WO | WO 95/27775 | | * | 10/1995 |
| WO | WO 96/12783 | | * | 5/1996 |
| WO | WO 96/23859 | | * | 8/1996 |
| WO | WO 96/23860 | | * | 8/1996 |
| WO | WO 96/23861 | | * | 8/1996 |

* cited by examiner

SOLID MACHINE DISHWASHING DETERGENT WITH PHOSPHATE AND CRYSTALLINE LAMELLAR SILICATES

This invention relates to a dishwasher detergent in solid form containing a builder combination of conventional phosphates and crystalline layer silicates. Despite its phosphate content, the detergent according to the invention offers improved protection to sensitive tableware, more particularly glasses and decorated tableware, and develops high cleaning performance and, in some cases, further improved cleaning performance compared with conventional phosphate-containing dishwasher detergents.

Now that domestic dishwashing machines are used on a relatively wide scale, it is known that highly alkaline phosphate/metasilicate-based dishwasher detergents, although developing high cleaning performance, show unfavorable behavior in regard to corrosion of decorated tableware, i.e. colored on-glaze and in-glaze decorations applied to china, decorated glasses and gold decorations gradually lose color intensity and brilliance.

The citrate- or phosphate-based low-alkali dishwasher detergents introduced onto the market in recent years also have the above-mentioned effect, although to a lesser extent.

These disadvantages can largely be eliminated by adding relatively large quantities of water-soluble amorphous silicates, more particularly amorphous disilicates. At the same time, however, glasses undergo irreversible damage after only a few dishwashing programs with disilicate-containing detergents, as reflected in clouding and iridescence (iridescent colors).

European patent application EP-A-0 504 091 (Viking) describes phosphate-free dishwasher detergents which develop high cleaning performance against tea stains. These known detergents contain about 5 to 15% by weight of crystalline layer silicates and, in addition, 10 to 15% by weight of citric acid and also (co)polymeric polycarboxylates. Unfortunately, the overall cleaning performance of these low-alkali dishwasher detergents against problem soils apart from tea is unsatisfactory. Although their performance in removing tea stains is very good, it could still be improved.

The dishwasher detergents described in International patent application WO-A-94/16047 (Procter & Gamble) show improvements in the protection of silverware through the use of builders, bleaching agents released at a certain time and paraffin oil in quantities of 0.05 to 2.5% by weight. Citrate-containing formulations are clearly preferred. Other suitable builders are alumosilicates, phosphates and even crystalline layer silicates. Combinations of phosphate and crystalline layer silicates are not mentioned or even suggested, nor is there any reference to advantages arising out of the use of such builder combinations.

Finally, International patent application WO-A-96/12783 (Henkel) describes phosphate-free or low-phosphate dishwasher detergents based on citrate-containing formulations incorporating crystalline layer silicates which combine improved protection of decoration and glassware with high cleaning performance against tea stains. Unfortunately, the overall cleaning performance is again in need of improvement.

European patent application EP-A-0 416 366 (Hoeschst) describes a dishwasher detergent which contains 30% by weight of sodium tripolyphosphate, 30% by weight of crystalline sodium layer silicate, preferably—as a proton donor—mineral acid and/or polycarboxylic acid and/or hydroxypolycarboxylic acids and/or phosphonic acids and/or acidic salts or esters thereof and which, overall, has a relatively low pH value. This known dishwasher detergent is characterized by its high cleaning performance.

However, detergents containing crystalline layer silicates as a builder raw material are also attended by the disadvantage that lime deposits can be formed on glass and crockery on account of the slow dissolving rate of the crystalline layer silicate. In addition, the raw material consists of very fine particles and contains large amounts of dust which can lead to production problems both in the manufacture of powders and granules and in the manufacture of dishwasher tablets.

Hitherto, there has been no satisfactory solution to the problem of ensuring decoration—and glass-protecting cleaning in combination with high cleaning performance as demanded by the consumer against such problem soils as tea, milk/milk products, egg/protein products, etc. coupled with safe manufacture free from production problems.

Accordingly, the problem addressed by the present invention was to provide a dishwasher detergent which would not have the disadvantages mentioned above, i.e. which would not cause any damage to glass, even after repeated use, but at the same time would develop high cleaning performance against tea stains and an excellent overall cleaning performance and which could be produced without any production problems both in the manufacture of powders and granules and in the manufacture of tablets.

It has surprisingly been found that this problem can be solved by phosphate-containing dishwasher detergents providing they contain crystalline layer silicates in a certain compounded form in addition to phosphates.

Accordingly, the present invention relates to a solid dishwasher detergent containing conventional phosphates and other typical ingredients, characterized in that, in addition to the phosphates, the detergent contains as an additional builder a powder-form or granular additive containing a crystalline layer silicate corresponding to general formula (I):

$$NaMSi_xO_{2x+1} \cdot y\ H_2O \qquad (I)$$

in which M is sodium or hydrogen, x is a number of 1.9 to 22 and preferably 1.9 to 4 and y is a number of 0 to 33, and (co)polymeric polycarboxylic acid as key constituents.

Conventional phosphates suitable for use as builders in dishwasher detergents include in particular alkali metal phosphates and polymeric alkali metal phosphates which may be present in the form of their alkaline, neutral or acidic sodium or potassium salts. Examples of such phosphates are trisodium phosphate, tetrasodium diphosphate, disodium dihydrogen diphosphate, pentasodium tripolyphosphate, so-called sodium hexametaphosphate, oligomeric trisodium phosphate with degrees of oligomerization of 5 to 1000 and more particularly 5 to 50 and the corresponding potassium salts or mixtures of sodium hexametaphosphate and the corresponding potassium salts or mixtures of sodium and potassium salts. The salts of the tripolyphosphate are particularly preferred. They are used in quantities of more than 30% by weight to 65% by weight and, more particularly, from 35 to 60% by weight, expressed as water-free active substance and based on the formulation as a whole.

Crystalline layer silicates corresponding to formula (I) are marketed by Clariant GmbH (Germany) under the trade name Na-SKS, including for example Na-SKS-1 ($Na_2Si_{22}O_{45}xH_2O$, kenyaite) Na-SKS-2 ($Na_2Si_{14}O_{29}xH_2O$, magadiite), Na-SKS-3 ($Na_2Si_8O_{17}xH_2O$), Na-SKS-4 ($Na_2Si_4O_9xH_2O$, makatite).

Compositions particularly suitable for the purposes of the invention are those containing crystalline layer silicates corresponding to formula (I) in which x is 2. Of these, Na-SKS-5 ($\alpha$-$Na_2Si_2O_5$), Na-SKS-7 ($\beta$-$Na_2Si_2O_5$ natrosilite), Na-SKS-9 ($NaHSi_2O_5.H_2O$), Na-SKS-10 ($NaHSi_2O_5.3H_2O$, kanemite), Na-SKS-11 ($\tau$-$Na_2Si_2O_5$) and Na-SKS-13 ($NaHSi_2O_5$), but especially Na-SKS-6 ($\delta$-$Na_2Si_2O_5$), are particularly suitable. An overview of crystalline layer silicates can be found, for example, in the articles published in "Hoechst High Chem Magazine 14/1993", pages 33–38 and in "Seifen-Öle-Fette-Wachse", Vol. 116, No. 20/1990", pages 805–808. According to the invention, the crystalline layer silicates corresponding to formula (I) are at least partly introduced into the dishwasher detergents according to the invention through the builder additive used in accordance with the invention. In one preferred embodiment of the invention, the crystalline layer silicates corresponding to formula (I) are introduced into the dishwasher detergents according to the invention solely through the builder additive used in accordance with the invention. The dishwasher detergents advantageously contain the crystalline layer-form silicate corresponding to formula (I) introduced through the builder additive in quantities of 2 to at most 30% by weight, preferably in quantities of 3 to 25% by weight and more preferably in quantities of 4 to 20% by weight.

In the context of the present invention, a (co)polymeric polycarboxylic acid is understood to be a non-neutralized or only partly neutralized homopolymer or copolymer. These include the homopolymers of acrylic or methacrylic acid and copolymers thereof with other ethylenically unsaturated monomers such as, for example, acrolein, dimethyl acrylic acid, ethyl acrylic acid, vinyl acetic acid, ally acetic acid, maleic acid, fumaric acid, itaconic acid, meth(allylsulfonic acid), vinyl sulfonic acid, styrene sulfonic acid, acrylamidomethyl propane sulfonic acid and monomers containing phosphorus groups such as, for example, vinyl phosphonic acid, allyl phosphoric acid and acrylamidomethyl propane phosphonic acid and salts thereof, and hydroxyethyl (meth) acrylate sulfates, allyl alcohol sulfates and allyl alcohol phosphates. Polymers such as these are described, for example, in German patent applications DE-A-23 57 036, DE-A-44 39 978 and in European patent applications EP-A-0 075 820 and EP-A-0 451 508.

Preferred (co)polymers have an average molecular weight of 1000 to 100,000 g/mole, preferably in the range from 2000 to 75,000 g/mole and more preferably in the range from 2000 to 35,000 g/mole. The degree of neutralization of the acid groups is advantageously between 0 and 90%, preferably between 10 and 80% and more preferably between 30 and 70%.

Other suitable polymers are, above all, homopolymers of acrylic acid and copolymers of (meth)acrylic acid with maleic acid or maleic anhydride.

Other suitable copolymers are derived from terpolymers which can be obtained by polymerization of 10 to 70% by weight of monoethylenically unsaturated dicarboxylic acids containing 4 to 8 carbon atoms or salts thereof, 20 to 85% by weight of monoethylenically unsaturated monocarboxylic acids containing 3 to 10 carbon atoms or salts thereof, 1 to 50% by weight of monounsaturated monomers, which release hydroxyl groups on the polymer chain after saponification, and 0 to 10% by weight of other radical-copolymerizable monomers. For the purposes of the use according to the invention, saponification of the monounsaturated monomers, which release a hydroxyl group on the polymer chain after saponification, is preferably carried out in a acidic medium. Products of the type mentioned above are described in German patent applications DE-A-43 00 772 and DE-A-195 16 957 and in WO-A-94/15978.

Graft polymers of monosaccharides, oligosaccharides, polysaccharides and modified polysaccharides, as described in German patent applications DE-A-40 03 172 and DE-A-44 15 623, are also suitable, as are the graft polymers with proteins of animal or vegetable origin disclosed in the European patent application, more particularly with modified proteins.

From the group of graft copolymers, copolymers of sugar and other polyhydroxy compounds and a monomer mixture with the following composition are preferably used: 45 to 96% by weight of monoethylenically unsaturated $C_{3-10}$ monocarboxylic acid or mixtures of $C_{3-10}$ monocarboxylic acids and/or salts thereof with monovalent cations, 4 to 55% by weight of monomers containing monoethylenically unsaturated monosulfonic acid groups, monoethylenically unsaturated sulfuric acid esters, vinyl phosphonic acid and/or the salts of these acids with polyvalent cations and 0 to 30% by weight of water-soluble monoethylenically unsaturated compounds modified with 2 to 50 moles of alkylene oxide per mole of monoethylenically unsaturated compound. Such compounds are described in DE-A-42 21 381 and in DE-A-43 43 993.

Other suitable polymers are polyaspartic acids and derivatives thereof in non-neutralized or only partly neutralized form. The polyaspartic acids normally accumulate in the form of their alkali metal or ammonium salts. The non-neutralized or only partly neutralized products may be obtained therefrom by adding appropriate quantities of organic or inorganic acids and optionally removing the salts formed.

Products of the type in question may also be obtained by the thermal reaction of maleic acid and ammonia or by the condensation of aspartic acid and subsequent hydrolysis of the polysuccinimide formed. The production of products such as these is described, for example, in DE-A-36 26 672, DE-A-43 07 114, DE-A-44 27 287, EP-A-0 612 784, EP-A-0 644 257 and WO-A-92/14753.

Graft polymers of acrylic acid, methacrylic acid, maleic acid and other ethylenically unsaturated monomers with the salts of polyaspartic acid normally accumulating in the above-described hydrolysis of the polysuccinimide are also particularly suitable. In their case, there is no need for the otherwise necessary addition of acid for the production of the only partly neutralized form of polyaspartic acid. The quantity of polyaspartate is normally selected so that the degree of neutralization of all the carboxyl groups incorporated in the polymer does not exceed 80%, preferably 60%. Products of the type mentioned are described in detail in International patent application WO-A-94/01486.

The quantities in which the non-neutralized or only partly neutralized (co)polymeric polycarboxylates are present in the compositions according to the invention are determined by the content of builder additives used in accordance with the invention and by their content of these polymers.

The builder additive used in accordance with the invention contains the crystalline layer silicate corresponding to formula (I) and the (co)polymeric polycarboxylic acid in a ratio by weight of preferably (40 to 1):1 and more preferably (20 to 2):1, ratios, of 7:1 to about 3:1, based on the water-free active substances, being particularly advantageous. The water content of the builder additives used in accordance with the invention is preferably 4 to 20% by weight, the upper appropriate limit to the water content being made dependent on the fact that the builder additive should still be stable and free-flowing and should not form any lumps, even after storage at elevated temperatures of, for example, 40° C. It has been found that the lower limit to the water content influences the dissolving behavior of the builder additive. Accordingly, in the interests of a higher dissolving rate of the builder additive, additives containing 5 to 15% by weight of water are preferred, those containing 7 to 12% by weight of water being particularly preferred. The water content is determined over a period of 4 hours at a temperature of 140° C.

The builder additives used in accordance with the invention may be produced simply by contacting the crystalline layer silicate corresponding to formula (I) with an aqueous solution, preferably a concentrated aqueous solution, of the (co)polymeric polycarboxylic acid, optionally followed by drying to the requisite water content. Conventional mixers and granulators, such as the Lödige plowshare mixer or a Schugi mixer or an Eirich mixer or a Lödige CB 30 Recycler and other machines known to the expert, which above all enable a liquid to be sprayed onto a solid, are as suitable as fluidized bed mixers/granulators. The polymer solution acts as an agglomeration aid. It is assumed that, in the reaction of the crystalline layer silicate corresponding to formula (I) with the acidic polymer, particularly where the polymer solution used has a pH value below 4, the sodium ions of the silicate are partly replaced by protons. However, the silicate skeleton with its layer structure and the majority of the sodium ions remain unchanged. The effect of this is that the builder additives used in accordance with the invention have only a slightly reduced starting alkalinity, but a far lower residual alkalinity than the pure crystalline layer silicate corresponding to formula (I). The residual alkalinity may be adjusted through the polymer acid content of the additives. Accordingly, the builder additive may be used as a buffer in the dishwasher detergents.

The builder additives may contain large quantities of (co)polymeric polycarboxylic acid, preferably quantities of 2 to 40% by weight, more preferably quantities of 5 to 30% by weight and most preferably quantities of 10 to 25% by weight. The content of crystalline layer silicates of formula (I) in the builder additives is preferably 50 to 90% by weight, more preferably 60 to 90% by weight and most preferably 65 to 85% by weight. The additives preferably have a calcium binding capacity above 185 mg $CaCO_3$/g. The pH value of a 0.1% by weight aqueous solution at 20° C. is preferably above 10, but below 12. The bulk density of the additives used in accordance with the invention varies according to the method used for their production and is normally above 400 to about 700 g/l. Whereas pure crystalline layer silicate corresponding to formula (I), such as SKS 6®, normally accumulates in very fine-particle form and also contains large amounts of dust, the builder additive used in accordance with the invention is a relatively coarse-particle powder or an agglomerate or granules which are finer when produced in a fluidized bed and coarser when produced, for example, in a high-speed mixer. Relatively coarse-particle additives have a mean particle size ($d_{50}$) of, for example, about 450 to 900 $\mu$m whereas relatively free-particle additives have a mean particle size ($d_{50}$) of about 280 to 330 $\mu$m. Even in the fine-particle additives, however, the percentage of dust is far lower than in the commercially available pure crystalline layer silicates corresponding to formula (I), more particularly SKS 6®.

The content of these builder additives in the dishwasher detergents according to the invention is variable within wide limits and depends both upon the content of crystalline layer silicates (I) in the dishwasher detergent formulation and upon the content of this crystalline layer silicate in the selected builder additive. Normal contents of these builder additives in the phosphate-containing dishwasher detergents are from about 2 to 40% by weight, contents of 5 to 35% by weight being preferred and contents of up to 30% by weight being particularly preferred.

Besides the ingredients used in accordance with the invention, the dishwasher detergents according to the invention, which may be present as granules, powders or tablets or other solid shaped bodies, may in principle contain any known ingredients typically present in dishwasher detergents. More particularly, the detergents according to the invention may contain other builders, surfactants, bleaching agents based on organic and/or more particularly inorganic peroxygen compounds, bleach activators, enzymes, sequestering agents, electrolytes, pH regulators and/or other auxiliaries such as, for example, silver corrosion inhibitors, foam regulators and dyes and perfumes. Tablets or other shaped bodies may also contain conventional disintegrators in the usual quantities.

In addition to the phosphates and the builder additives, the dishwasher detergents according to the invention ay also contain one or more other builders from the group of carbonates, hydrogen carbonates, amorphous silicates, crystalline layer-form silicates, which have not been introduced via the additive, and polybasic carboxylic acids or salts thereof, more particularly citric acid or citrate. In one preferred embodiment of the invention, however, the detergents do not contain any crystalline silicates of formula (I) which have not been introduced into the formulation through the builder additive. The detergents may also contain other (co)polymeric polycarboxylates of the usual type which are also soluble in water and which may serve as co-builders, particularly under hard water conditions. Other (co) polymeric polycarboxylates which may be used in accordance with the invention are, for example, polyacrylic acids and copolymers of maleic anhydride and acrylic acid and the sodium salts of these polymeric acids. Commercially available products are, for example, Sokalan® CP 5, CP 10 and PA 30 (BASF). Other commercially available and suitable polymers are, for example, POC QUAL AS 2057® (Degussa), Norasols®, such as Norasol LMW 45N®, Norasol SP 02N® and Norasol 470 N® (Rohm & Haas) or Alcosperse 175 N® (Alco). Polymers of native origin suitable as co-builders include, for example, oxidized starch, as known for example from International patent application WO 94/05762, as polyamino acids, such as polyglutamic acid and polyaspartic acid. Other possible builder components are naturally occurring hydroxycarboxylic acids such as, for example, monohydroxy and dihydroxy succinic acid, $\alpha$-hydroxypropionic acid and gluconic acid. Preferred organic builder components include the salts of citric acid, more particularly sodium citrate. The sodium citrate may be used as anhydrous trisodium citrate, but is preferably used in the form of trisodium citrate dihyrate. Trisodium citrate dihydrate may be used in the form of a fine or coarse crystalline powder. The acids corresponding to the co-builder salts mentioned may also be present, depending upon the pH value ultimately established in the detergents according to the invention. In a preferred embodiment, the dishwasher detergents according to the invention contain no more than 2% by weight of these additional (co)polymeric polycarboxylates which are not introduced via the builder additive. In one particular embodiment, the detergents are even free from these additional (co)polymeric polycarboxylates which have not been introduced via the builder additive.

Carbonates and hydrogen carbonates are among the alkalinity sources typically used. The detergents according to the invention may contain their sodium and/or potassium salts, for example in a quantity of 10 to 40% by weight and preferably 15 to 30% by weight, based on the detergent as a whole.

In view of the above-mentioned possible adverse effects of amorphous silicates and, above all, amorphous sodium silicates with a ratio by weight of $Na_2O$ to $SiO_2$ of 1:1.8 to 1:3.3 and more particularly up to 1:2.5, these alkalinity sources are preferably present in the dishwasher detergents in quantities of less than 4% by weight and, more particularly, less than 2% by weight. Particularly preferred detergents are advantageously free from amorphous silicates and also from metasilicates.

Peroxygen compounds suitable for use in detergents according to the invention include, in particular, organic per acids or peracidic salts of organic acids, such as phthalimidopercaprioc acid, perbenzoic acid or salts of diperdodecanedioic acid, hydrogen peroxide and inorganic salts which release hydrogen peroxide under the washing/cleaning conditions, including perborates, percarbonates and/or persilicates. Hydrogen peroxide may also be produced by an enzymatic system, i.e. an oxidase and its substrate. If solid peroxygen compounds are to be used, they may be used in the form of powders or granules which may also be coated in known manner. A particularly preferred embodiment is characterized by the use of alkali metal percarbonate, alkali metal perborate monohydrate, alkali metal perborate tetrahydrate or hydrogen peroxide in the form of aqueous solutions containing 3% by weight to 10% by weight of hydrogen peroxide. If a detergent according to the invention contains peroxygen compounds, they are present in quantities of preferably up to 50% by weight and more preferably from 5% by weight to 30% by weight. The addition of small quantities of known bleach stabilizers, for example phosphonates, borates or metaborates and metasilicates, and magnesium salts, such as magnesium sulfate, can be useful.

However, other typical oxygen bleaching agents are the organic per acids. Preferred organic per acids include above all the highly effective phthalmidoperoxycaproic acid, although any other known per acids may be used in principle.

Compounds which form aliphatic peroxocarboxylic acids containing preferably 1 to 10 carbon atoms and more preferably 2 to 4 carbon atoms and/or optionally substituted perbenzoic acid under perhydrolysis conditions may be used as bleach activators. Substances bearing O- and/or N-acyl groups with the number of carbon atoms mentioned and/or optionally substituted benzoyl groups are suitable. Preferred bleach activators are polyacylated alkylenediamines, more particularly tetraacetyl ethylenediamine (TAED), acylated triazine derivatives, more particularly 1,5-diacetyl-2,4-dioxohexahydro-1,3,5-triazine (DADHT), acylated glycolurils, more particularly tetraacetyl glycoluril (TAGU), N-acylimides, more particularly N-nonanoyl succinimide (NOSI), acylated phenol sulfonates, more preferably n-nonanoyl- or isononanoyl-oxygenzenesulfonate (n- or iso-NOBS), carboxylic anhydrides, more particularly phthalic anhydride, acylated polyhydric alcohols, more particularly triacetin, ethylene glycol diacetate, 2,5-diacetoxy-2,5-dihydrofuran and the enol esters known from German patent applications DE 196 16 693 and DE 196 16 767, acetylated sorbitol and mannitol and the mixtures thereof (SORMAN) described in European patent application EP 0 525 239, acylated sugar derivatives, more particularly pentaacetyl glucose (PAG), pentaacetyl fructose, tetraacetyl xylose and octaacetyl lactose, and acetylated, optionally N-alkylated glucamine and gluconolactone, and/or N-acylated lactams, for example N-benzoyl caprolactam, which are known from International patent applications WO 94/27970, WO 94/28102, WO 94/28103, WO 95/00626, WO 95/14759 and WO 95/17498. The substituted hydrophilic acyl acetals known from German patent application DE 196 16 769 and the acyl lactams described in German patent application DE 196 16 770 and in International patent application WO 95/14075 are also preferably used. The combinations of conventional bleach activators known from German patent application DE 44 43 177 may also be used. Bleach activators such as these are present in the usual quantities, preferably in quantities of 1% by weight to 10% by weight and more preferably in quantities of 2% by weight to 8% by weight, based on the detergent as a whole.

In addition to or instead of the conventional bleach activators mentioned above, the sulfonimines known from European patents EP 0 446 982 and EP 0 453 003 and/or bleach-boosting transition metal salts or transition metal complexes may also be present as so-called bleach catalysts. Suitable transition metal compounds include, in particular, the manganese-, iron-, cobalt-, ruthenium- or molybdenum-salen complexes known from German patent application DE 195 29 905 and the N-analog compounds thereof known from German patent application DE 196 20 267, the manganese-, iron-, cobalt-, ruthenium- or molybdenum-carbonyl complexes known from German patent application DE 195 36 082, the manganese, iron, cobalt, ruthenium, molybdenum, titanium, vanadium and copper complexes with nitrogen-containing tripod ligands described in German patent application DE 196 05 688, the cobalt-, iron-, copper- and ruthenium-ammine complexes known from German patent application DE 196 20 411, the manganese, copper and cobalt complexes described in German patent application DE 44 16 438, the cobalt complexes described in European patent application EP 0 272 030, the manganese complexes known from European patent application EP 0 693 550, the manganese, iron, cobalt and copper complexes known from European patent EP 0 392 592, the cobalt complexes known from International patent applications WO 96/23859, WO 96/23860 and 96/23861 and/or the manganese complexes described in European patent EP 0 443 651 or in European patent application EP 0 458 397, EP 0 458 398, EP 0 549 271, EP 0 549 272, EP 0 544 490 and EP 0 544 519. Combinations of bleach activators and transition metal bleach catalysts are known, for example, from German patent applications DE 196 13 103 and from international patent application WO 95/27775. Bleach-boosting transition metal complexes, more particularly with the central atoms Mn, Fe, Co. Cu, Mo. V, Ti and/or Ru, are used in typical quantities, preferably in a quantity of up to 1% by weight, more preferably in a quantity of 0.0025% by weight to 0.25% by weight and most preferably in a quantity of 0.01% by weight to 0.1% by weight, based on the detergent as a whole. A bleach-boosting combination prepared by thoroughly mixing a water-soluble salt of a divalent transition metal selected from cobalt, iron, copper and ruthenium and mixtures thereof, a water-soluble ammonium salt and optionally a peroxygen-based oxidizing agent and also inert carrier materials is described, for example, in earlier German patent application P 197 09 284.5.

Although, in principle, chlorine-containing bleaching agents may be present in the detergents according to the invention and the invention also encompasses chlorine-containing formulations, chlorine-free bleaching agents only are preferably used.

Dishwasher detergents according to the invention may contain corrosion inhibitors as an ingredient for protecting the tableware or the machine itself, silver protectors being particularly important for dishwashing machines. Known corrosion inhibitors, for example those described in DE 43 25 922, DE 41 28 672 and DE 43 38 724, may be used. Above all, silver protectors selected from the group of triazoles, benzotriazoles, bisbenzotriazoles, aminotriazoles, alkylaminotriazoles and the transistion metal salts or complexes may generally be used. Benzotriazole and/or alkylaminotriazole is/are particularly preferred. In addition, dishwashing formulations often contain corrosion inhibitors containing active chlorine which are capable of distinctly reducing the corrosion of silver surfaces. According to the above documents, chlorine-free dishwashing detergents contain in particular oxygen- and nitrogen-containing organic redox-active compounds, such as dihydric and trihydric phenols, for example hydroquinone, pyrocatechol, hydroxyhydroquinone, gallic acid, phloroglucinol, pyrogallol and derivatives of these compounds. Salt-like and complex-like inorganic compounds, such as salts of the metals Mn, Ti, Zr, Hf, V, Co and Ce are also frequently used. Of these, the transition metal salts selected from the group of manganese and/or cobalt salts and/or complexes are preferred, cobalt(ammine) complexes, cobalt(acetate) complexes, cobalt(carbonyl) complexes, chlorides of cobalt or manganese and manganese sulfate being particularly preferred. Zinc compounds may also be used to prevent corrosion of tableware. These silver protectors may normally be present in quantities of up to about 5% by weight.

Enzymes suitable for use in the detergents are enzymes from the class of proteases, lipases, cutinases, amylases, pullunases, oxidases and peroxidases, glucanases and mixtures thereof, for example, such as BLAP®, Optimase®, Opticlean®, Maxacal®, Maxapem®, Alcalase®, Esperase®, Savinase®, Durazym® and or Purafect® OxP; amylases, such as Termamyl®, Amylase-LT®, Maxamyl®, Duramyl® and/or Purafect® OxAm; lipases, such as Lipolase®, Lipomax®, Lumafast® and/or Lipozym®. Enzymes obtained from fungi or bacteria, such as *Bacillus subtilis,* Bacillus Licheniformis, *Streptomyces griseus, Humicola lanuginosa, Humicola insolens, Pseudomonas pseudoalcaligenes* and *Pseudomonas cepacia* are particularly suitable. These enzymes optionally used as an additional ingredient may be absorbed onto supports and/or encapsulated in membrane materials to protect them against premature inactivation, as described for example in European patent EP 0 564 476 and in International patent application WO 94/23005. They are present in the dishwasher detergents according to the invention in quantities of preferably up to 10% by weight and more preferably from 0.05% by weight to 5% by weight, enzymes stabilized against oxidative degradation, as known for example from International patent applications WO 94/02597, WO 94/02618, WO 94/18314, WO 94/23053 or WO 95/07350, being particularly preferred. The proteases preferably used in detergents according to the invention include the enzymes known from International patent applications WO 91/02792, WO 92/21760 and WO 95/23221.

Surfactants, more particularly low-foaming nonionic surfactants, optionally in admixture with anionic and/or switterionic surfactants, may also be added as optional ingredients to the detergents according to the invention. Such surfactants promote the removal of fatty soils, serve as wetting agents and optionally act as granulation aids in the production of the detergents. They may be used in quantities of up to 10% by weight, preferably up to 5% by weight and more preferably in the range from 0.5% by weight to 3% by weight. Extremely low-foaming compounds are normally used, especially in detergents intended for use in dishwashing machines. Preferred compounds of this type are $C_{12-18}$ alkyl polyethylene glycol polypropylene glycol ethers containing up to 8 moles ethylene oxide and 8 moles propylene oxide units in the molecule. However, other known low-foaming nonionic surfactants may also be used, including for example $C_{12-18}$ alkyl polyethylene glycol polybutylene glycol ethers containing up to 8 moles ethylene oxide units and 8 moles butylene oxide units in the molecule, end-capped alkyl polyalkylene glycol mixed ethers and the foaming, but ecologically attractive $C_{8-14}$ alkyl polyglucosides with a degree of polymerization of about 1 to 4 (for example APG® 225 and APG® 500 of Henkel KGaA) and/or $C_{12-14}$ alkyl polyethylene glycols containing 3 to 8 ethylene oxide units in the molecule. Surfactants from the glucamide family such as, for example, alkyl-N-methyl glucamides in which the alkyl moiety preferably emanates from a $C_{6-14}$ fatty alcohol, are also suitable. It is of advantage in some cases to use the described surfactants in the form of mixtures, for example alkyl polyglycoside in admixture with fatty alcohol alkoxylates or glucamide in admixture with alkyl polyglycosides. The hydroxyl-containing alkoxylated alcohols described in EP-A-0 300 305 are also particularly preferred. It has been found that these hydroxy mixed ether surfactants have an excellent clear rinse effect. This applies in particular to mixtures with other nonionic surfactants, such as fatty alcohol alkoxylates, for example Dehypon LS 54®, in admixture with Dehydol LS 4®, to mixtures of hydroxy mixed ethers and APG® and to mixtures of fatty alcohol, ethoxylates, hydroxy mixed ethers and alkyl polyglycoside. Besides the clear-rinse effect, these surfactant mixtures also contribute towards significantly reducing stress cracking in plastics.

Suitable anionic surfactants are, in particular, soaps and those which contain sulfate or sulfonate groups with—preferably—alkali metal ions as cations. Preferred soaps are the alkali metal salts of saturated and unsaturated $C_{12-18}$ fatty acids. Fatty acids such as these may also be used without complete neutralization. Suitable surfactants of the sulfate type include the salts of sulfuric acid semiesters of $C_{12-18}$ fatty alcohols and the sulfation products of the above-mentioned nonionic surfactants with a low degree of ethoxylation. Suitable surfactants of the sulfonate type include linear alkyl benzenesulfonates containing 9 to 14 carbon atoms in the alkyl moiety, alkane sulfates containing 12 to 18 carbon atoms and olefin sulfonates containing 12 to 18 carbon atoms, which are formed in the reaction of corresponding monoolefines with sulfur trioxide, and $\alpha$-sulfofatty acid esters which are formed in the sulfonation of fatty acid methyl or ethyl esters.

If the detergents foam too vigorously in use, for example where anionic surfactants are present, up to 6% by weight and preferably from about 0.5% by weight to 4% by weight of a foam-suppressing compound, preferably from the group of silicon oils, mixture of silicon oil and hydrophobicized silica, paraffins, paraffin/alcohol combinations, hydrophobicized silica, bis-fatty acid amides and other known commercially available defoamers, may be added to them. Other optional ingredients in the detergents according to the invention are, for example, perfume oils.

The dishwasher detergents according to the invention are present in solid form. They may be made up as powders or granules or even as shaped bodies, more particularly tablets. They may be conventionally produced, for example by mixing, granulation, compacting, such as roller compacting, tabletting and/or by spray drying. In some cases, the ingredients may even be used in precompounded form for the production of the dishwasher detergents according to the invention.

The tablets may be single-phase or multiphase, single-color or multicolored tablets and, more particularly, may consist of one layer or of several layers, more particularly two layers—a form in which tablets are already commercially available. In multilayer tablets, the builder additive may be present either in one layer only or may be distributed over several layers or all the layers.

To produce detergents according to the invention in the form of tablets, all the ingredients—optionally for each layer—may be mixed together in a mixer and the resulting mixture tabletted in conventional tablet presses, for example eccentric presses or rotary presses, under pressures of about 50 to 100 kN and preferably under pressures of 60 to 70 kN. In the case of multilayer tablets in particular, it can be of advantage if at least one layer is compressed in advance, preferably under pressure of 5 to 20 kN and more particularly 10 to 15 kN. Fracture-resistant tablets which still dissolve sufficiently quickly under in-use conditions are readily obtained in this way; they have fracture and flexural strengths of normally 100 to 200 N and preferably above 150 N. A tablet produced in this way preferably has a weight of 15 g to 40 g and, more particularly, 20 g to 30 g. The tablets may be of any shape, including round, oval or angular and variations thereof. Corners and edges are advantageously rounded off. Round tablets preferably have a diameter of 30 mm to 40 mm. The size of rectangular or square tablets in particular, which are mainly introduced from dispensing compartments, for example of dishwashers, is dependent on the geometry and the size of the dispensing compartment. For example, preferred embodiments have a base area of (20 to 30 mm)×(34 to 40 mm) and, more particularly, 26×36 mm or 24×38 mm.

Dishwasher detergents according to the invention in the form of dust-free, storage-stable and free-flowing powders and/or granules with high bulk densities of 750 to 1200 g/l can be produced by mixing the builder components with at least part of the liquid components in a first stage in which the bulk density of the resulting premix is also increased and then combining the other components of the dishwasher detergent with the premix thus obtained, if desired after drying.

The detergents according to the invention are added by hand or, as indicated above, by suitable dispensers. The concentrations in which they are used in the main wash cycle, whether or not a prerinse cycle has taken place, are preferably from about 2 to 8 g/l and more preferably from 2 to 5 g/l.

The dishwashing program is generally augmented and terminated by a few rinse cycles with clear water after the main wash cycle and a final rinse cycle with a conventional rinse aid. After drying, completely clean and hygienically satisfactory tableware free from tea and other stains is obtained. Even after numerous wash cycles, the advantages afforded by using the detergents according to the invention, such as improved glass protection and decoration protection, are clearly in evidence.

However, the dishwasher detergents according to the invention not only develop very high cleaning performance against tea stains, they also produce significant improvements in the removal of protein-containing soils and soils produced by milk products in relation to dishwasher detergents of comparable composition which also contain phosphate and crystalline layer silicates corresponding to formula (I), but—in the case of the latter—in powder form and not in the form of the builder additive used in accordance with the invention. In contrast to formulations containing fine-particle crystalline layer silicate, the production of the powders, granules or tablets according to the invention is problem-free.

EXAMPLES

Example 1

25-gram tablets with the compositions shown in Table 1 below were produced, TE1 being the tablet according to the invention and TV1 the direct composition product.

TABLE 1

Compositions of TE1 and TV1 (in % by weight)

| | TE1 | TV1 |
|---|---|---|
| Tripolyphosphate (as water-free active substance) | 51.0 | 51.0 |
| Amorphous sodium disilicate (as water-free active substance) | — | 4.5 |
| Sodium salt of the copolymer of acrylic acid and maleic anhydride (Sokalan CP5 ®) | — | 2.1 |
| Builder additive consisting of 71% by weight SKS 6 ® 20% by weight terpolymer 9% by weight water | 6.0 | — |
| Sodium carbonate | 17.0 | 16.5 |
| Sodium perborate monohydrate | 9.0 | 9.0 |
| Bleach activator TAED | 2.1 | 2.1 |
| Phosphonate | 0.9 | 0.8 |
| Dehypon LS 54 ® | 1.5 | 1.5 |
| Dehypon LT 104 ® | 0.5 | 0.5 |
| Enzyme | 3.8 | 3.7 |
| Perfume, dye, tabletting aid, silver protector and water | Balance | Balance |

Dehypon LS 54® and Dehypon LT 104® are two low-foaming fatty alcohol alkoxylates produced by Henkel KGaA.

The terpolymer present in the builder additive had been produced from 80% by weight acrylic acid and maleic acid in a ratio by weight of 7:3 and 20% by weight vinyl acetate in accordance with the disclosure of WO-A-94/15978 and then saponified in an acidic medium. The terpolymer was acquired commercially from Stockhausen.

The effect of Tablets TE1 and TV1 on sensitive tableware after 100 and 150 dishwashing cycles (clouding (T) and iridescence (I) in three lime soda glasses, there potash crystal glasses and three lead crystal glasses) was tested in Miele G 570 and G 575 dishwashers—which had been modified for continuous operation (year of manufacture: 1993)—under the following conditions: universal program 65° C., one dishwasher tablet, 50 g of a soil mixture of fats, protein, starch, milk, coloring agents and preservative, 5.0 liters water with a hardness of 0 to 1°d in the main wash cycle. Scoring was carried out visually by personnel trained in the inspection of tableware for damage. The scores shown in Tables 2a and 2b were awarded, the worst-looking glass in its category being scored. The scores awarded had the following meanings:

0: no change
1: slight changes, still acceptable
2: moderate changes, still acceptable
3: significant changes, no longer acceptable
4: very serious changes, no longer acceptable.

TABLE 2a

Results for TE1 and TV1 after 100 wash cycles

| Material | TE1 | | TV1 | |
|---|---|---|---|---|
| Lime soda glass | T 1-2 | I 0 | T 2-3 | I 0 |
| Potash crystal glass | T 1 | I 0 | T 3 | I 2 |
| Lead crystal glass | T 0 | I 0 | T 0 | I 3 |

TABLE 2b

Results for TE1 and TV1 after 150 wash cycles

| Material | TE1 | | TV1 | |
|---|---|---|---|---|
| Lime sodaglass | T 1-2 | I 0 | T 2 | I 0 |
| Potash crystal glass | T 1 | I 0 | T 3-4 | I 1 |
| Lead crystals glass | T 0 | I 0 | T 0 | 1 3 |

The advantages of tablet TE1 according to the invention over comparison tablet TV1 are very clear from Tables 2a and 2b.

Example 2

Powders with the compositions shown in Table 3 were produced in the usual way, PE1 to PE3 being the powders according to the invention and PV1 the comparison powder. The powders were tested for their preserving effect and for bloom. The effects of powders PE1 to PE3 and PV1 on sensitive tableware were tested as in Example 1 in a dose of 25 g to 5 liters of water after 100 wash cycles (PE1 to PE3 and PV1) and after 300 wash cycles (only PE1 and PE2 compared with PV1 after 100 wash cycles). The results are set out in Tables 4a and 4b.

TABLE 3

Compositions of PE1 to PE3 and PV1 (in % by weight)

| | PV1 | PE1 | PE2 | PE3 |
|---|---|---|---|---|
| Premix of: Makrophos ® (tripolyphosphate) (75.83% by weight) sodium carbonate (21.41% by weight) Dehypon LS 54 ® (2.07% weight) Dehypon LT 104 ® (0.69% by weight) | 72.53 | 71.9 | 72.8 | — |
| Makrophos ® | — | — | — | 51.8 |
| Dehypon LS 54 ® | — | — | — | 1.5 |
| Dehypon LT 104 ® | | | | 0.5 |
| Amorphous sodium disilicate (as water-free active substance) | 4.0 | — | — | — |
| Builder additive consisting of 71% by weight SKS 6 ® 20% by weight of terpolymer 9% by weight of water | — | 5.63 | 11.5 | 28.2 |
| Sodium perborate monohydrate (compactate) with soda in a ratio of 9:1) | 10.0 | 10.0 | 10.0 | 10.0 |
| Bleach activator TAED | 2.1 | 2.1 | 2.1 | 2.1 |
| Enzymes | 3.4 | 3.4 | 34. | 3.4 |

TABLE 3-continued

Compositions of PE1 to PE3 and PV1 (in % by weight)

| | PV1 | PE1 | PE2 | PE3 |
|---|---|---|---|---|
| Sodium carbonate | 5.75 | 5.75 | — | 1.8 |
| Perfume, dye, silver protector, water | Balance | Balance | Balance (no silver protector) | Balance |

Table 4a. Results for PE1 to PE3 and PV1 after 100 wash cycles

| Material | PV1 | PE1 | PE2 | PE3 |
|---|---|---|---|---|
| Lime soda-glass | T 3 I 0 | T 0 I 0 | T 3 I 0 | T 3 I 0 |
| Potash crystal glass | T 3 I 0 | T 0 I 0 | T 1 I 0 | T 3 I 0 |
| Lead crystal glass | No change | No change | No change | No change |

Table 4b. Results for PE1 to PE2 after 300 wash cycles (PV1 for comparison after 100 wash cycles)

| Material | PV1 | PE1 | PE2 |
|---|---|---|---|
| Lime soda glass | T 3 I 0 | T 1 I 0 | T 1 I 0 |
| Potash crystal glass | T 3 I 0 | T 1 I 0 | T 1 I 0 |
| Lead crystal glass | No change | No change | No change |

The advantages of formulations PE1 and PE2 according to the invention over PV1 are clearly apparent from Tables 4a and 4b. Even with a high content of the builder additive of 28.2% by weight in PE3, corresponding to an active substance content of crystalline layer disilicate of 20% by weight, the results obtained are similar to those obtained with PV1 containing 4% by weight amorphous sodium disilicate. As Table 5 shows, however, PE3 also has clear advantages over PV1 when the loss of color on decorated glass plates was evaluated. To this end, red-decorated glass plates (Arcopol "bande rouge") were tested under the same conditions in addition to the glasses mentioned above. The loss of color FV was determined after 50 and 150 wash cycles. The scores awarded had the same meanings as explained above.

TABLE 5

Loss of color from decorated glass plates

| Wash cycles | PV1 | PE1 | PE2 | PE3 |
|---|---|---|---|---|
| 50 | FV 2 | FV 2 | FV 2 | FV 0 |
| 150 | FV 4 | FV 4 | FV 4 | FV 1 |

Example 3

The cleaning performance of a detergent PE4 according to the invention was tested against a comparison detergent PV2 which contained SKS6® in powder form and non—according to the invention—as a builder additive (see also Table 6). The results are set out in Table 7.

TABLE 6

Compositions of PE4 and PV2 (in % by weight)

| | PE4 | PV2 |
|---|---|---|
| Tripolyphosphate (Thermophos ® 1018) | 40.0 | 40.0 |
| SKS 6 ® | — | 20.0 |
| Builder additive (as above) | 15.5 | — |
| Sodium carbonate | 27.5 | 15.0 |
| Sodium perborate | 10.0 | 10.0 |
| TAED | 2.0 | 2.0 |
| Genapol 2909D ® (nonionic surfactant) | 2.0 | 2.0 |
| Protease | 2.0 | 2.0 |
| Amylase | 1.0 | 1.0 |

Genapol is a low-foaming fatty alcohol alkoxylate produced by Clariant.

TABLE 7

Cleaning performance of PE4 by comparison with PV2 (in %)

| Soil type | PE4 | PV2 |
|---|---|---|
| Oat flakes | 88.0 | 80.0 |
| Egg | 100 | 98.5 |
| Minced meat, intensive | 100 | 100 |
| Spinach | 100 | 100 |
| Tea | 100 | 100 |
| Milk | 81.0 | 67.0 |

The comparison formulation PV2 had distinct advantages over phosphate-free formulations, particularly against minced meat, spinach and tea. The formulation according to the invention improved this performance, i.e. was effective against egg and protein-containing soils and, quite clearly, against mil and soils of milk products and oatflakes.

What is claimed is:

1. A solid dishwasher detergent comprising:

a) at least one phosphate; and b) at least one builder additive in compounded form comprising i) 65 to 90 percent by weight of the builder additive of at least one crystalline layer silicate corresponding to the general formula (I):

$$NaMSi_xO_{2x+1}.yH2O \quad (I)$$

wherein M is sodium or hydrogen, x is a number from 1.9 to 22, and y is a number from 0 to 33; and ii) 2 to 40 percent by weight of the builder additive of at least one (co)polymeric polycarboxylic acid.

2. The solid dishwasher detergent of claim 1, wherein the at least one crystalline layer silicate is present in an amount of from 2 to 30 percent by weight of the solid dishwasher detergent.

3. The solid dishwasher detergent of claim 1, wherein the at least one phosphate is present in an amount, expressed as water-free active substance, of more than 30 to 65 percent by weight of the solid dishwasher detergent.

4. The solid dishwasher detergent of claim 1, wherein the solid dishwasher detergent comprises at least one additional builder selected from the group consisting of carbonates, hydrogen carbonates, amorphous silicates, polybasic carboxylic acids, polybasic carboxylic acid salts, and crystalline layer silicates not added via the at least one builder additive.

5. The solid dishwasher detergent of claim 1, further comprising less than 4 percent by weight of at least one amorphous silicate.

6. The solid dishwasher detergent of claim 1, wherein the solid dishwasher detergent is substantially free of amorphous silicates and metasilicates.

7. The solid dishwasher detergent of claim 1, wherein the at least one builder additive is present in an amount of from 2 to 40 percent by weight of the solid dishwasher detergent.

8. The solid dishwasher detergent of claim 1, wherein the builder additive further comprises water in an amount of from 4 to 20 percent by weight of the builder additive.

9. The solid dishwasher detergent of claim 8, wherein (i) the at least one crystalline layer silicate is present in an amount of from 65 to 85 percent by weight of the builder additive, (ii) the at least one (co)polymeric polycarboxylic acid is present in an amount of from 10 to 25 percent by weight of the builder additive, and (iii) the water is present in an amount of from 7 to 12 percent by weight of the builder additive.

10. The solid dishwasher detergent of claim 1, wherein the at least one (co)polymeric polycarboxylic acid has a molecular weight of from 1,000 to 100,000 g/mol and a degree of neutralization of the acid groups of from 0 to 90 percent.

11. The solid dishwasher detergent of claim 1, further comprising at least one substance selected from the group consisting of oxygen bleaching agents, chlorine bleaching agents, bleach activators, and bleach catalysts.

12. The solid dishwasher detergent of claim 1, further comprising at least one surfactant.

13. The solid dishwasher detergent of claim 12, wherein the at least one surfactant comprises at least one low-foaming nonionic surfactant.

14. The solid dishwasher detergent of claim 13, wherein the at least one low-foaming nonionic surfactant is selected from the group consisting of (i) $C_{12-18}$ alkyl polyethylene glycol polypropylene glycol ethers having up to 8 moles of ethylene oxide units and 8 moles of propylene oxide units, (ii) $C_{12-18}$ alkyl polyethylene polybutylene glycol ethers having up to 8 moles of ethylene oxide units and 8 moles of butylene oxide units, (iii) end-capped alkyl polyalkylene glycol mixed ethers, (iv) $C_{8-14}$ alkyl polyglucosides with a degree of polymerization of about 1 to 4, (v) $C_{12-14}$ alkyl polyethylene glycols having 3 to 8 ethylene oxide units, (vi) glucamides, (vii) hydroxy mixed ethers, and (vii) mixtures thereof.

15. The solid dishwasher detergent of claim 13, further comprising a mixture comprising hydroxy mixed ethers and fatty alcohol alkoxylates or alkyl polyglycoside.

16. The solid dishwasher detergent of claim 13, further comprising a mixture comprising hydroxy mixed ethers, fatty alcohol ethoxylates and alkyl polyglycoside.

17. The solid dishwasher detergent of claim 1, wherein the solid dishwasher detergent is in a tablet form.

18. The solid dishwasher detergent of claim 1, wherein the solid dishwasher detergent is in a powder form.

19. The solid dishwasher detergent of claim 1, wherein the solid dishwasher detergent is in a granular form.

* * * * *

UNITED STATES PATENT AND TRADEMARK OFFICE

CERTIFICATE OF CORRECTION

PATENT NO. : 6,462,006 B1
DATED : October 8, 2002
INVENTOR(S) : Sorg et al.

It is certified that error appears in the above-identified patent and that said Letters Patent is hereby corrected as shown below:

Title page,
After [22] PCT Filed:, delete "May 28, 1999", and insert therefor
-- April 21, 1999 --.

Signed and Sealed this

Sixteenth Day of September, 2003

JAMES E. ROGAN
*Director of the United States Patent and Trademark Office*